US008127965B1

(12) United States Patent
Miller

(10) Patent No.: US 8,127,965 B1
(45) Date of Patent: Mar. 6, 2012

(54) TOOL BUCKET ORGANIZER

(76) Inventor: Kirk W. Miller, New London, IA (US)

( * ) Notice: Subject to any disclaimer, the term of this patent is extended or adjusted under 35 U.S.C. 154(b) by 385 days.

(21) Appl. No.: 12/454,328

(22) Filed: May 15, 2009

(51) Int. Cl.
*B65D 25/32* (2006.01)

(52) U.S. Cl. ..... 220/735; 220/529; 220/528; 206/373; 211/70.6

(58) Field of Classification Search ..... 220/529, 220/23.87, 737, 528, 23.88, 904, 735; 206/349, 206/372, 373, 561, 562; 211/60.1, 69, 70.6
See application file for complete search history.

(56) References Cited

U.S. PATENT DOCUMENTS

| | | | | |
|---|---|---|---|---|
| 3,951,079 | A * | 4/1976 | Tolleson | 108/94 |
| 4,362,243 | A | 12/1982 | Deyesso et al. | |
| 4,765,472 | A | 8/1988 | Dent | |
| 4,826,007 | A | 5/1989 | Skeie | |
| 4,867,332 | A | 9/1989 | Mains | |
| 4,911,295 | A | 3/1990 | Venegoni | |
| 4,925,026 | A | 5/1990 | McKay | |
| 4,993,551 | A | 2/1991 | Lindsay | |
| 5,186,329 | A | 2/1993 | Fogelberg | |
| 5,261,556 | A | 11/1993 | Gatto | |
| 5,350,065 | A | 9/1994 | Darrey | |
| D372,125 | S | 7/1996 | Frazier | |
| 5,924,568 | A | 7/1999 | Zajonc | |
| 6,360,891 | B1 * | 3/2002 | Rideout | 206/373 |
| 7,159,735 | B2 * | 1/2007 | Morse | 220/529 |
| 7,954,650 | B1 * | 6/2011 | Malik | 211/70.6 |
| 2005/0115476 | A1 * | 6/2005 | Savoie | 108/115 |

* cited by examiner

*Primary Examiner* — Anthony Stashick
*Assistant Examiner* — Kareen Rush
(74) *Attorney, Agent, or Firm* — Montgomery Patent & Design, LLC; Robert C. Montgomery; Joseph T. Yaksich

(57) ABSTRACT

An insert for containers designed to store and organize small hand tools comprising two (2) discs, each of a slightly smaller diameter than the interior diameter of the bucket is herein disclosed. Each disc is provided with multiple holes and slots to hold various types of hand tools. The discs are separated a few inches from each other and the lower insert is held off the bottom of the bucket by a set of legs. The insert is designed to hold hand tools such as screwdrivers, pliers, wrenches, hammers, utility knifes and the like. The configuration of the discs allows each tool to stand upright and not fall over, enabling a user to quickly find a desired hand tool.

7 Claims, 3 Drawing Sheets

TOOL BUCKET ORGANIZER

RELATED APPLICATIONS

The present invention was first described in a notarized Official Record of Invention on Jun. 3, 2008, that is on file at the offices of Montgomery Patent and Design, LLC, the entire disclosures of which are incorporated herein by reference.

FIELD OF THE INVENTION

The present invention relates generally to a tool holder and, more particularly, to said holder which provides a removable tool holding and organizing means for use with plastic buckets.

BACKGROUND OF THE INVENTION

The plastic five-gallon bucket, while initially intended as packaging for building materials, food, and the like from a manufacturer or distributer, have become a very popular and utilitarian tool for many people. In many cases the buckets cannot be reused for their initial purpose, especially when used for food packaging, and therefore have historically been thrown away and sent to the landfill leading to thousands of buckets a day discarded. Thus, in this age of growing environmental awareness the five gallon bucket continues to find common and imaginative alternative uses and has become known as the ultimate recyclable.

One (1) extremely common and popular alternative use of the bucket is as a makeshift tool carrier, especially among professional laborers and domestic do-it-yourselfers. Tool buckets make inexpensive containers for transporting tools and materials to and from a job site and around the work area. The bucket also provides the benefit of providing a durable container that will not rust or corrode and is easily carried from job task to job task and of catching smaller materials which may be dropped during work. Many laborers use a number of various tools and materials every day and it is desirous to have those tools organized and readily accessible, especially when both hands are unavailable while in the midst of performing a task. One (1) solution has been to simply carry all the tools in the bucket, haphazardly piling them inside with no organization. Another has been to carry multiple tool boxes, bags, or material containers which can be cumbersome and inconvenient. Various accessories for the bucket used as a tool carrier have attempted to solve these disadvantages, ranging from textile inserts, to covers, seat assemblies and the like. One (1) disadvantage they pose however is that the tools typically end up in a tangled mess in the middle of the container or hang loosely from the sides. The tools often fall over on top of each other, thereby forcing the user to remove all tools to find the desired one (1) on the bottom. The canvas tool holders force the user to pull open and peer inside of each pocket, all of which takes time and caused aggravation while performing a task.

Various attempts have been made in the past to overcome these disadvantages and provide a means of stowing and organizing hand tools while transporting the tools in a bucket, although the present invention substantially departs from the conventional solutions and in doing so provides a means by which various commonly used tools can be carried and organized within a tool bucket without the aforementioned problems. Among the relevant attempts to address these problems are several U.S. Patents, including U.S. Pat. Nos. 4,765,472; 4,826,007; 4,867,332; 4,925,026; 5,261,556; and 5,924,568.

U.S. Pat. No. 4,362,243, issued in the name of Deyesso et al., describes a tool holder insert adapted to engage the inner surface of the wall of a plastic bucket comprising an annular configurations and apertures and notches for holding tools.

U.S. Pat. No. 4,911,295, issued in the name of Venegoni, describes a bucket organizer tray comprising a plurality of trays along a circular bottom wall which is joined to an annular peripheral sidewall which removably fits inside a plastic bucket for sorting various parts or tools.

U.S. Pat. No. 4,993,551, described in the name of Linsday, describes a tool holder and storage device which interfits over the upper rim of a plastic bucket comprising a tubular cloth panel which drapes of the inside and outside surface of the bucket and outer pockets sewn on the outside draping surface for holding various tools.

U.S. Pat. No. 5,350,065, issued in the name of Darrey, describes a tool and hardware carrier for a bucket comprising an insert with a circular planer top member positioned near the top of the bucker and a plurality of apertures and slots to receive tools.

Additionally, ornamental designs for bucket caddies and tool organizers exist, particularly, U.S. patent No. D 372,125. However, none of these designs are similar to the present device.

While these devices fulfill their respective, particular objectives, each of these references suffers from one or more of the aforementioned disadvantages. Accordingly, the need has developed for a means by a user can easily find and retrieve hand tools stored and transported in a five-gallon bucket. The development of the present invention fulfills this need.

SUMMARY OF THE INVENTION

In view of the foregoing references, the inventor recognized the aforementioned inherent problems and observed that there is a need for a means to stow and carry various hand tools in a common bucket in an organized and secure manner and thus, the object of the present invention is to solve the aforementioned disadvantages.

To achieve the above objectives, it is an object of the present invention to provide a tool bucket organizer which provides a means for storing and organizing small hand tools. The invention is slidingly inserted into a bucket and provides a rigid organizing structure within the bucket for tools to be held.

Another object of the bucket organizer is to provide a device comprising an upper disk, a lower disk, a plurality of tool holding means, and an attachment means which is removably inserted into a standard three-and-a-half- to five gallon bucket.

Yet still another object of the bucket organizer is to provide the upper and lower disk comprising equal diameters which are attached together via an attachment means which provides a spatial gap between the upper and lower disks. The diameter of the disks is slightly less than that of an internal lower diameter of the bucket.

Yet another object of the bucket organizer is to provide the upper and lower disks comprising a plurality of identically placed and aligned tool holding means and a plurality of identically placed and aligned leg spacer apertures.

Yet still another object of the bucket organizer is to provide the plurality of tool holding means comprising through hole apertures in the upper and lower disks. The apertures comprise various sizes and shapes suitable to receive various sizes and types of commonly used hand tools.

Yet still another object of the bucket organizer is to provide the attachment means comprising a plurality of spacer legs which provide a resting and attachment means to the upper and lower disks while maintaining them at a set distance from one another and a multi-legged support means while inside the bucket or when placed on any horizontal surface.

Yet still another object of the bucket organizer is to provide the spacer legs comprising a top portion, a middle portion, and a base portion. The spacer leg tapers upwardly comprising the top portion having a smaller diameter than the middle portion and the middle portion having a smaller diameter than the base portion.

Yet still another object of the bucket organizer is to provide the base portion which provides the resting means for the lower disk to set comprising a radial horizontal surface.

Yet still another object of the bucket organizer is to provide the middle portion which provides the distance between the upper and lower disks and the resting means for the upper disk to set comprising a radial horizontal surface.

Yet still another object of the bucket organizer is to provide the upper disk comprising a plurality of leg spacer apertures suitably sized to receive the top portion and rest on the upper horizontal radius of the middle portion.

Yet still another object of the bucket organizer is to provide the lower disk comprising a plurality of leg spacer apertures suitably sized to receive the middle portion and rest on the upper horizontal surface of the base portion.

Yet still another object of the bucket organizer is to provide the device comprising a durable material.

Yet still another object of the bucket organizer is to provide a method of utilizing the device which allows professionals and do-it-yourself handymen the ability to store and transport hand tools without fear of loss or damage while at the same time saving time in looking for the tool when needed.

Further objects and advantages of the bucket organizer will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | tool bucket organizer |
| 20 | upper disk |
| 30 | lower disk |
| 40 | aperture |
| 50 | spacer leg |
| 51 | top |
| 53 | middle |
| 55 | base |

-continued

| | |
|---|---|
| 60 | bucket |
| 65 | handle |
| 70 | tool |

DETAILED DESCRIPTION OF THE PREFERRED EMBODIMENT

Figure 1:
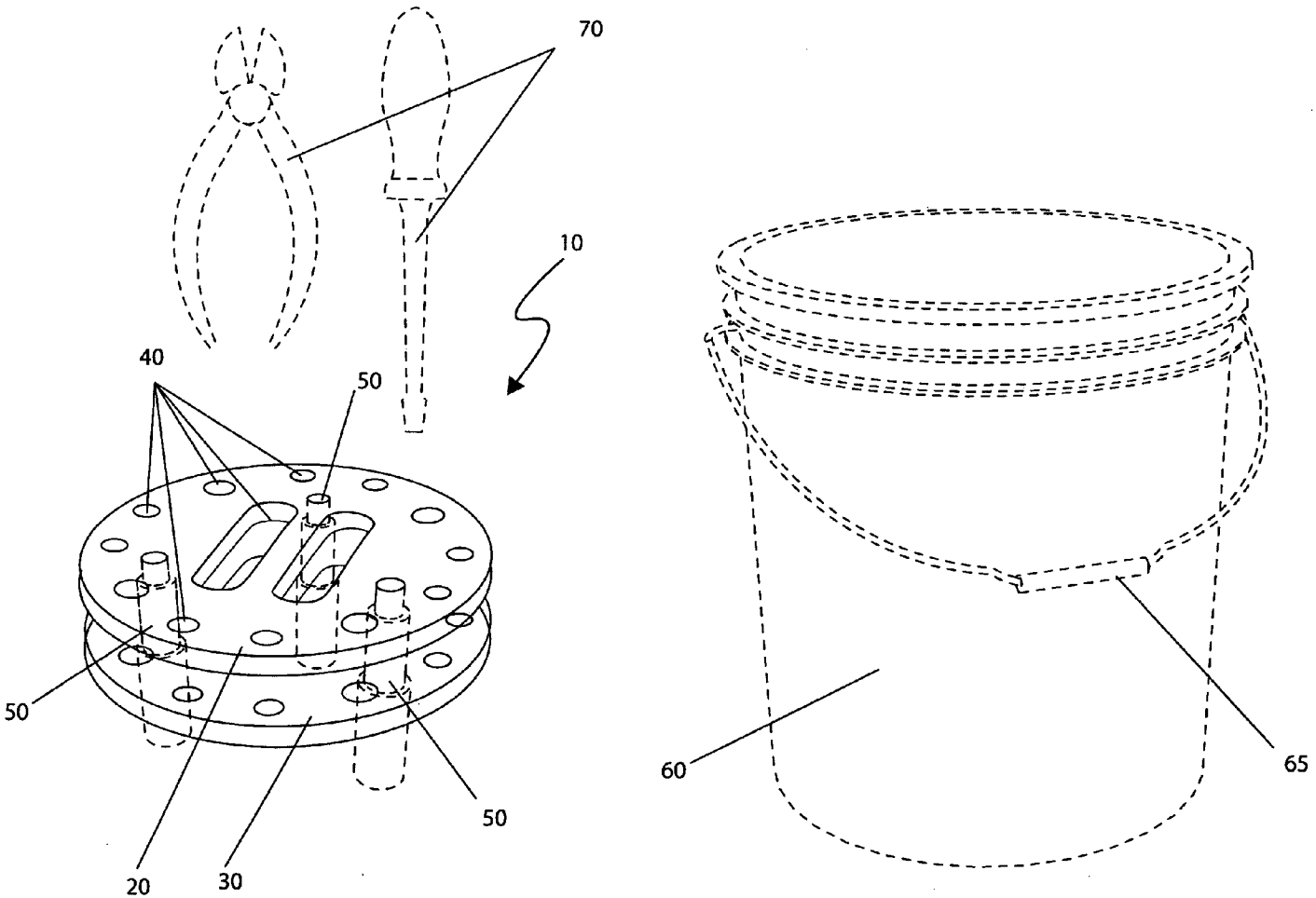
FIG. 1 is an environmental view of a tool bucket organizer 10, according to a preferred embodiment of the present invention.
Figure 3:
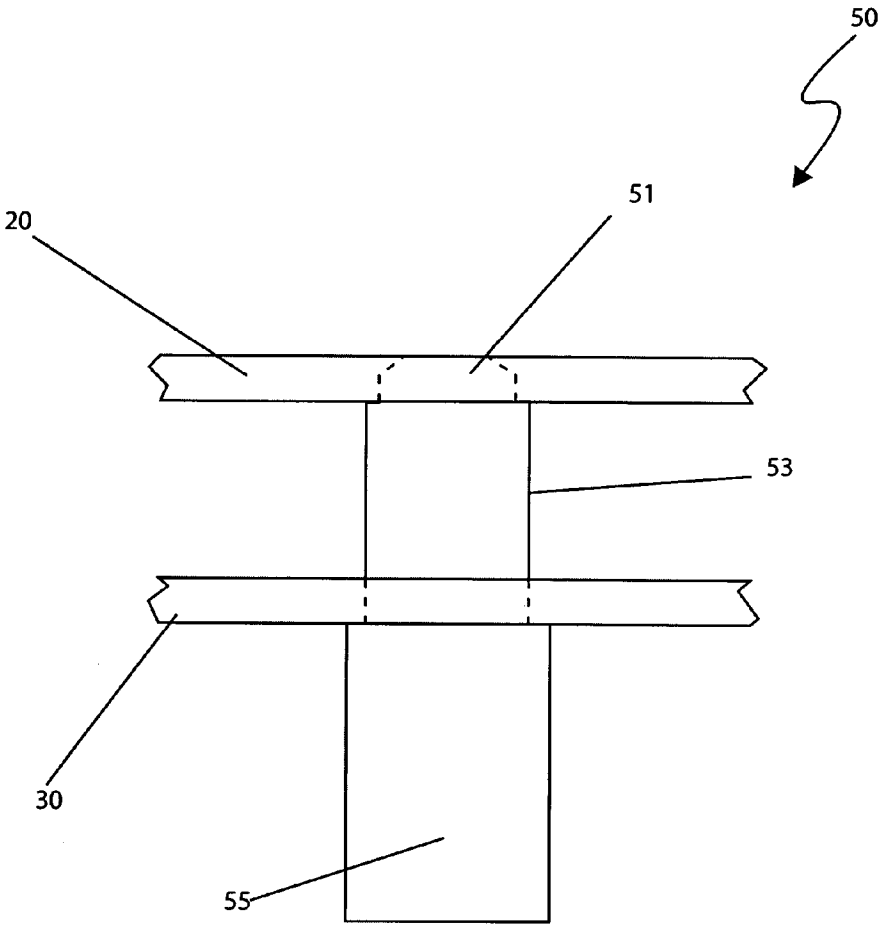

The best mode for carrying out the invention is presented in terms of its preferred embodiment, herein depicted within the FIGS. 1 and 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a tool bucket organizer (herein described as the "device") 10, which provides a means for storing and organizing small hand tools 70. The device 10 comprises a pair of identical disks, a plurality of apertures, and three (3) spacer legs 50. The device 10 and is removably inserted thereinto a standard three-and-a-half-to five-gallon bucket 60 by a slidably engaging means. The device 10 enables a user to easily insert and remove tools 70. The device 10 is also easily transported thereby a handle 65.

Referring now to FIG. 1, an environmental view of the device 10, according to the preferred embodiment of the present invention, is disclosed. The device 10 comprises an upper disk 20 and a lower disk 30 both of which are of an equal diameter. Said diameter comprises a dimension slightly less than the corresponding inside diameter of the bucket 60. The upper disk 20 and lower disk 30 comprises a plurality of identically placed apertures and slots of various diameters, thereby providing a placement means for an assortment of tools 70. Both the upper disk 20 and the lower disk 30 are envisioned to be fabricated from a plastic material such as, but not limited to: acrylic glass, polystyrene (PS), or the like. Other materials, besides plastics, may also be used such as, but not limited to: metal, wood, or the like.

Figure 2:
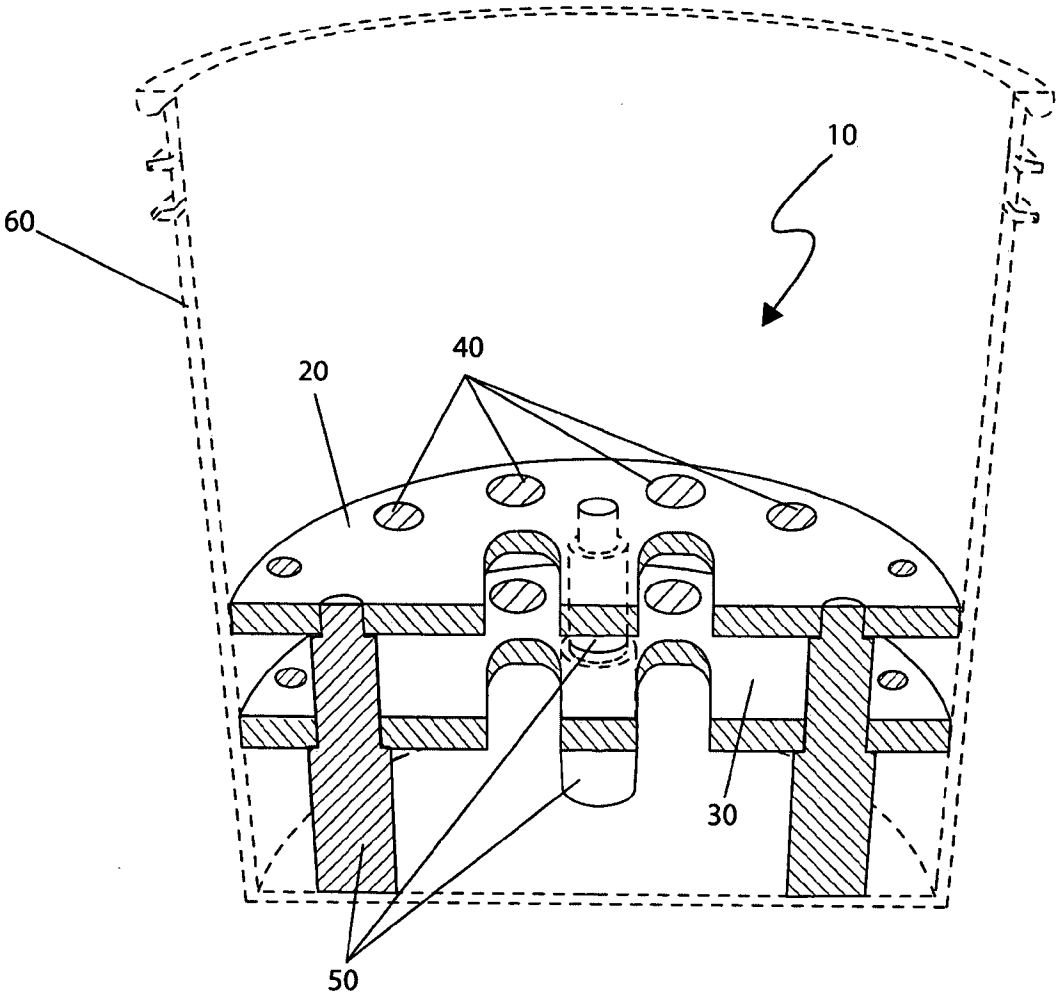
FIG. 2 is a section view of the tool bucket organizer 10 depicting placement therein a bucket 60, according to a preferred embodiment of the present invention; and, FIG. 3 is a front view of a spacer leg 50 for the tool bucket organizer 10, according to a preferred embodiment of the present invention.

Referring now to FIG. 2, a section view of the device 10, according to the preferred embodiment of the present invention, is disclosed. The device 10 comprises three (3) spacer legs 50 providing an attachment means thereto the upper disk 20 and lower disk 30 using processes such as, but not limited to: interference fit, plastic weld, and/or common adhesives. The spacer legs 50 also separate the disks an approximate distance of three (3) inches from one another to provide a secure upright placement thereto the tools 70 once inserted thereinto the device 10 (see FIG. 3). It is envisioned that the spacer legs are fabricated from an identical material as the upper disk 20 and lower disk 30.

Referring now to FIG. 3, a front view of a spacer leg 50, according to the preferred embodiment of the present invention, is disclosed. The spacer leg 50 comprises a top 51 portion, a middle 53 portion, and a base 55 portion. The top 51 portion possesses a chamfered edge, thereby providing the user effortlessness when inserting the spacer leg 50 thereinto the lower disk 30 and upper disk 20. The middle 53 portion of the spacer leg 50 possesses a wider diameter than the top 55; thereby providing a resting means thereto the upper disk 20 thereon an upper portion of the spacer leg 50. The base 55 portion of the spacer leg 50 possesses an even wider diameter than that of the middle 55 portion; thereby providing the lower disk 30 with a resting means thereon an intermediate portion the spacer leg 50.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the device 10; placing the device 10 thereinto the bucket 60 with the base 55 portion of the spacer legs 50 touching the bottom of the bucket 60; placing a tool 70 into an apertures 40; placing additional tools 70 into additional apertures 40 as desired; carrying the device 10 with the handle 65 of the bucket 60 and, removing the device 10 and tools 70 as needed.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tool bucket organizer for storing and organizing small hand tools, said tool bucket organizer comprising:

a lower disk and a coextensively shaped and horizontally aligned upper disk[s], each of said disks comprising a plurality of apertures formed therein adapted for receiving a small hand tool; and, a plurality of cylindrical spacer legs insertably attached between said disks and statically mated thereto such that said disks are spaced apart at a fixed vertical distance, each of said spacer legs comprising a base portion, a middle portion comprising a diameter smaller than said base portion, and a top portion comprising a diameter smaller than said middle portion;

wherein said lower disk further comprises a first plurality of spacer apertures formed therein, each of said spacer apertures comprising a diameter suitably sized to receive said top portion and said middle portion of said spacer leg and be mechanically limited by said base portion;

wherein said upper disk further comprises a second plurality of spacer apertures formed therein, each of said spacer apertures comprising a diameter suitably sized to receive said top portion of said spacer leg and be mechanically limited by said middle portion;

wherein corresponding pairs of said apertures in said lower disk and said upper disk are vertically aligned;

wherein said tool bucket organizer is adapted to be removably inserted an existing within a tool bucket such that said lower disk is spaced apart from a bottom surface of said tool bucket by said base portion of said spacer legs; and, wherein said hand tool is supported in a generally vertical orientation at an upper location by said upper disk, at a central location by said lower disk, and at a lower location by said bottom surface of said tool bucket.

2. The tool bucket organizer of claim 1, wherein said upper disk and said lower disk each having an equal diameter, said upper and lower disks being registered parallel to each other and further being oriented along mutually exclusive upper and lower planes respectively.

3. The tool bucket organizer of claim 2, wherein each of said spacer legs top portion further comprises a chamfered edge interfitted into a corresponding one of said second plurality of spacer apertures of said upper disk.

4. The tool bucket organizer of claim 3, wherein a top edge of said middle portion of each said spacer legs supports a bottom surface of said upper disk directly above said lower disk.

5. The tool bucket organizer of claim 4, wherein a top edge of said base portion of each said spacer legs supports a bottom surface of said lower disk directly above said bottom surface of said tool bucket.

6. The tool bucket organizer of claim 5, wherein an end of said top portion further comprises a flat surface coplanar to an upper surface of said upper disk.

7. The tool bucket organizer of claim 6, wherein each of said disks further comprises a substantially annular shape.

* * * * *